US005797823A

United States Patent [19]

Gouvis, II

[11] Patent Number: 5,797,823

[45] Date of Patent: Aug. 25, 1998

[54] STRAIN REDUCING WEIGHTED JOGGING BELT

[76] Inventor: George A. Gouvis, II, 4991 Persimmon La., Irvine, Calif. 92612

[21] Appl. No.: 813,802

[22] Filed: Mar. 6, 1997

[51] Int. Cl.[6] ..... A63B 21/00

[52] U.S. Cl. ..... 482/105; 482/74; 482/124

[58] Field of Search ..... 482/105, 74, 124; 602/19

[56] References Cited

U.S. PATENT DOCUMENTS

| | | | |
|---|---|---|---|
| D. 134,542 | 12/1942 | Wax | 108/109 |
| D. 230,441 | 2/1974 | Moyer | D2/381 |
| D. 257,409 | 10/1980 | Kishbaugh | D2/383 |
| D. 259,151 | 5/1981 | Kishbaugh | D2/383 |
| D. 279,120 | 6/1985 | Spangler | D21/191 |
| 3,532,339 | 10/1970 | Smith | 272/57 |
| 3,659,843 | 5/1972 | Kojigian, Jr. | 272/57 R |
| 3,713,299 | 1/1973 | Duncan | 61/70 |
| 4,180,261 | 12/1979 | Kolka | 272/119 |
| 4,441,707 | 4/1984 | Bosch | 272/119 |
| 4,905,491 | 3/1990 | Alston | 482/105 |
| 5,076,575 | 12/1991 | Eylander | 272/119 |

*Primary Examiner*—Jerome Donnelly

*Attorney, Agent, or Firm*—Gene Scott-Patent Law & Venture Group

[57] ABSTRACT

A joggers belt includes a waist band of a resilient material. The band mounts a series of pouches having weight elements within them. The band is configured so that as the jogger moves the weight elements tend to compress the band so that the full force of the weight elements is applied to the jogger's skeleton over a period of time thereby reducing the maximum forces that are applied to the jogger's joints. This result is supported and improved by forming the band with a triangular cross section so that the weights are tilted with respect to the joggers waist. In one embodiment, the weights are spring mounted so as to further extend the force timing of the belt.

3 Claims, 2 Drawing Sheets

STRAIN REDUCING WEIGHTED JOGGING BELT

BACKGROUND OF THE INVENTION

1. Field of the Invention

This invention relates generally to weighted belts and more particularly to an improved weighted belt designed to move in harmonic motion with a jogger, thereby providing an improved weight training while decreasing, or in the optimal case, eliminating any strain placed on the jogger's joints due to the added weight.

2. Description of Related Art

Invention and use of weighted belts are known to the public, as they are worn to advantage during exercise related activities, and sports including weightlifting, diving and jogging. Prior art weighted belts take on a wide variety of different embodiments and designs.

For example, Bosch U.S. Pat. No. 4,44,707 discloses an exercise belt designed to encircle the waist of the wearer. A flexible line with handles attached to its opposite ends is slidingly attached to the belt to allow for longitudinal, reciprocal motion of the flexible line with respect to the belt. While jogging, the user can simultaneously exercise upper and lower body muscles by simply grasping the handles in opposite hands and alternately pushing one handle forwardly, while simultaneously resisting rearward movement of the other handle. This isometrically exercises the user's arm and upper body muscles.

Kojigian, Jr. U.S. Pat. No. 3,659,843 discloses an exercising belt to be worn around the waist of the user for use as a weight-reducing device and exercising device. The belt includes spring members having moveable balls arranged within it, the balls cooperate with the spring members and associated parts to provide massage to the midsection of the trunk so as to reduce fat buildup.

Duncan, U.S. Pat. No. 3,713,299 discloses a weight belt for underwater divers comprising a plurality of connected elongated, substantially circular compartments for containing lead weights. The compartments are formed of a flexible high strength cloth material, and they are long enough to extend from one hip of the wearer, around the back of the wearer and to the front of the other hip. The ends of the belt are joined together by a buckle assembly including a strap on one end and a safety type buckle on the other end.

Smith, U.S. Pat. No. 3,532,339 discloses a flexible weighted belt having an elongate enclosure and a plurality of small weight means received within the enclosure without impairing its flexibility. Interengageable flexible means of different lengths are secured to opposite end portions of the enclosure to form an adjustable closed loop by which the belt can be temporarily secured to a person.

Kolka, U.S. Pat. No. 4,180,261 teaches that to acquire greater speed in running, variable weights are attached to the fronts of the thighs slightly above the knees. The weights and the pocketing structure are suspended from a waist belt by adjustable hip suspension straps. Greater effort is required in picking up the legs while running and muscles important to running are thereby strengthened.

Eylander, U.S. Pat. No. 5,076,575 teaches a weight belt comprising a sheet of flexible material having two strips of material over one face and joined by stitching seams to form a number of pockets side-by-side, the pockets containing plates of lead, and being closed by further folding of the sheet to bring the pockets face to face, where they are retained by touch and hold material. They can be lifted away for adding or reducing the number of lead plates. Access to some of the plates can be provided to allow removal or replacement without necessarily removing the belt.

Belt designs are disclosed in Kishbough et al., U.S. Design Pat. Nos. 259,151 and 257,409, Moyer, U.S. Pat. No. 230,441, Wax, U.S. Pat. No. 1134,542, and Spangler U.S. Design Pat. No. 279,120. However, as disclosed, none of the prior art devices are designed to reduce strain placed on the wearer's back and knees. Instead, their construction is such that when they are properly secured around the wearer, the added weight increases the strain placed on the wearer's skeleton. In addition, most of these prior art devices provide no means by which to cushion the wearer from contact with the weights, and therefore bruising often results.

The prior art does not teach that a belt may be provided with a means for allowing the weight to be attached so that the weight moves over a vertical path that is coordinated by but not in synchronization with the vertical motion of the runner. The advantage to this is that the change of direction of the weight occurs when the runner's joints are not in strain from his own weight. Thus, there is a clear need for an improved weighted jogging belt designed to move in non-synchronized motion with the wearer, thus allowing the wearer to enjoy the maximum strength building and weight loss benefits associated with wearing the belt while also minimizing strain and damage to the joints of his skeleton. The present invention fulfills these needs and provides further related advantages as described in the following summary.

SUMMARY OF THE INVENTION

The present invention is an improved weighted belt designed to provide added weight resistance during exercise, particularly jogging. Thus it is a primary object of the present invention to significantly improve performance results, as the increased weight provides for both increased fat burn and increased muscle gain.

However, unlike prior art designs, it is a primary object of the instant invention to move the weight of the belt in non-synchronized harmonic motion with the body so that the extra weight on the runner produces minimal stress effects on the wearer's skeleton. It is also an object of the present invention to significantly reduce the perceived shock or transfer of vibration to a jogger. These objects are accomplished by, in one embodiment, constructing the belt of a foam material of a density, size and shape that effectively enables sympathetic motion to occur and yet limits the amplitude and duration of the vibrations so that the weight's motion is out of synchronization with the runners body. Alternately, the sympathetic motion and damping may be achieved by a spring mounting of the weights positioned within the belt.

The belt itself has a height appropriate for supporting the jogger's back. Thus, it is an object of the present invention to serve as a back brace providing support to the lower spine as the jogger moves.

Pockets are positioned on the belt for removably receiving weights. The pockets preferably include a flap with hook and loop type fasteners so as to allow weights to be quickly and easily removed as needed. Thus, it is one object of the instant invention to provide a weighted belt in which the belt's weight can be easily adjusted to adhere to a range of different fitness levels.

It is another object of the invention to provide for maximum wearer comfort and to prevent bruising of the wearer's body. This is accomplished by the unique foam padding of which the belt is constructed and also by the flexible nature of the weights. Unlike prior art devices in which hard metal weights are utilized, the present invention uses flexible weights that form mold to the user. These weights are preferably constructed of iron pellets or lead or iron shot. This flexible weight construction also provides for increased life of the weights, as they may be dropped and otherwise mistreated without being damaged.

In both preferred embodiments described, the weights are set, or mounted, on springs or spring-like material, which may be selected or adjusted so that as the jogger moves vertically while running, the weights move with a delayed action with respect to the jogger. This results in the weight moving out of synchronization with the jogger so that the knee and foot joints are not subjected to excessive forces.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention, a weighted jogger's belt. In such drawings.

DETAILED DESCRIPTION OF THE PREFERRED EMBODIMENT

Figure 1:
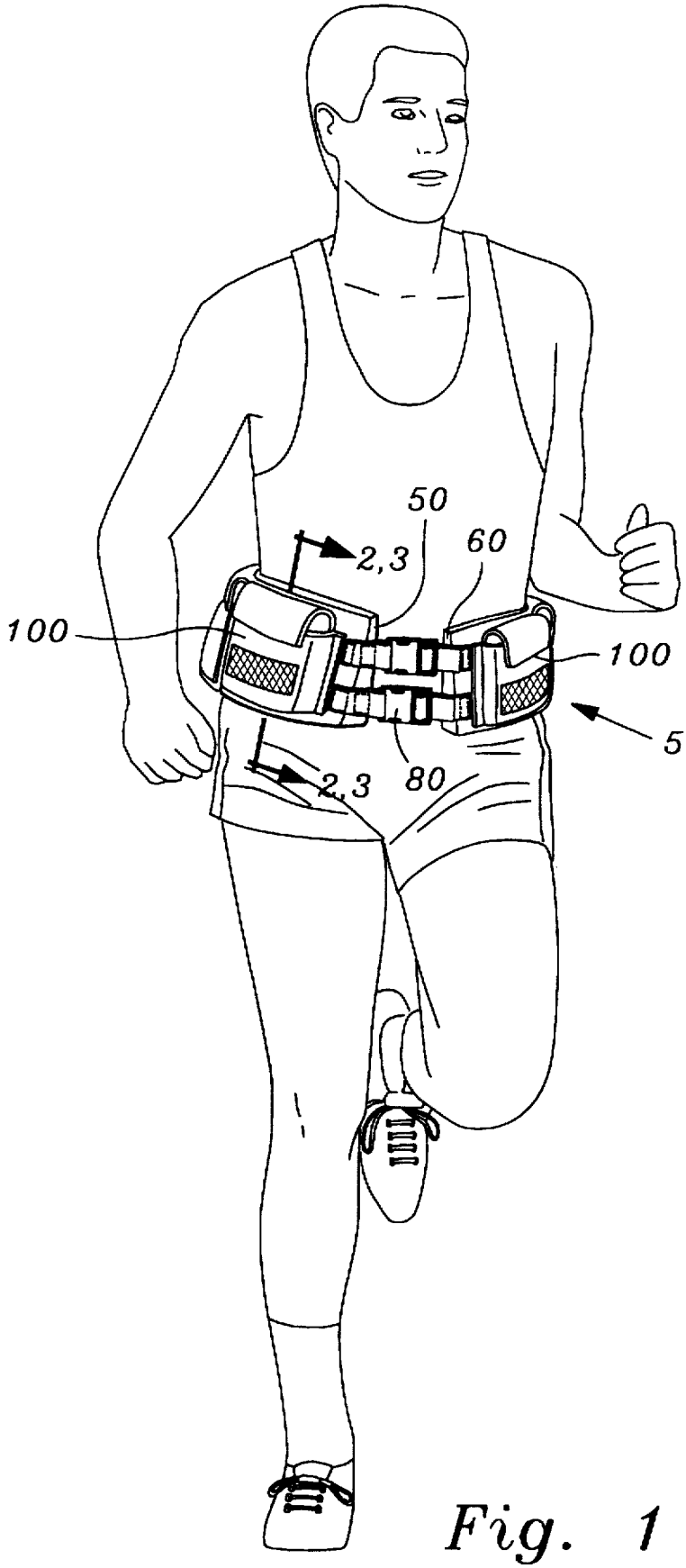
FIG. 1 is a perspective view of the preferred embodiment of the invention, particularly showing the manner in which the belt is attached to, and worn by, a jogger.
Figure 3:
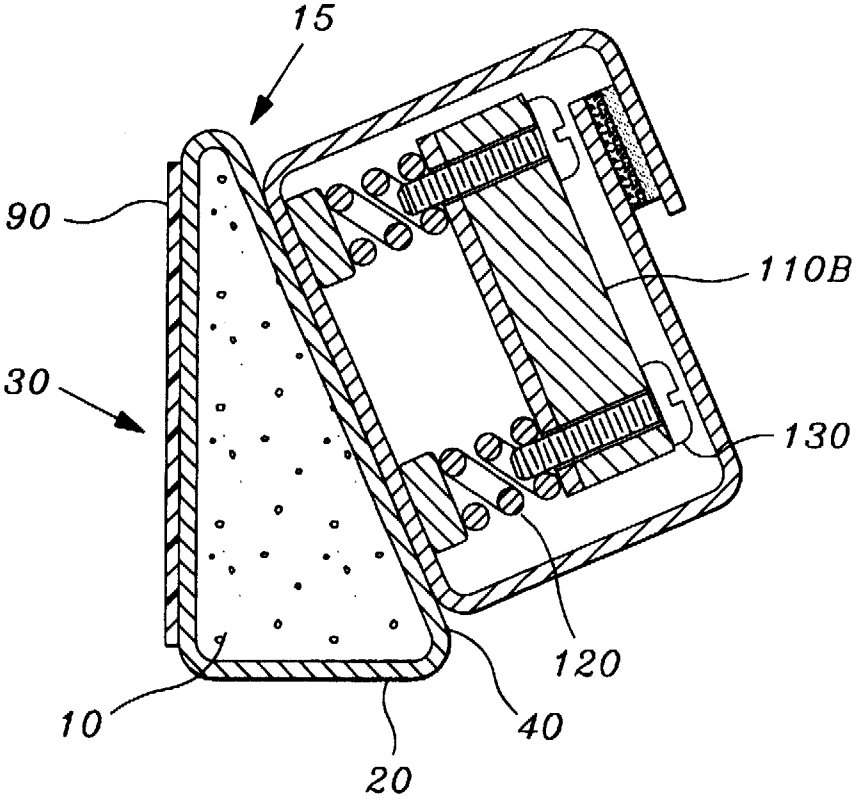
FIG. 3 is a section view taken along line 3—3 in FIG. 1 and particularly shows the interior construction of the invention in a second embodiment.
Figure 2:
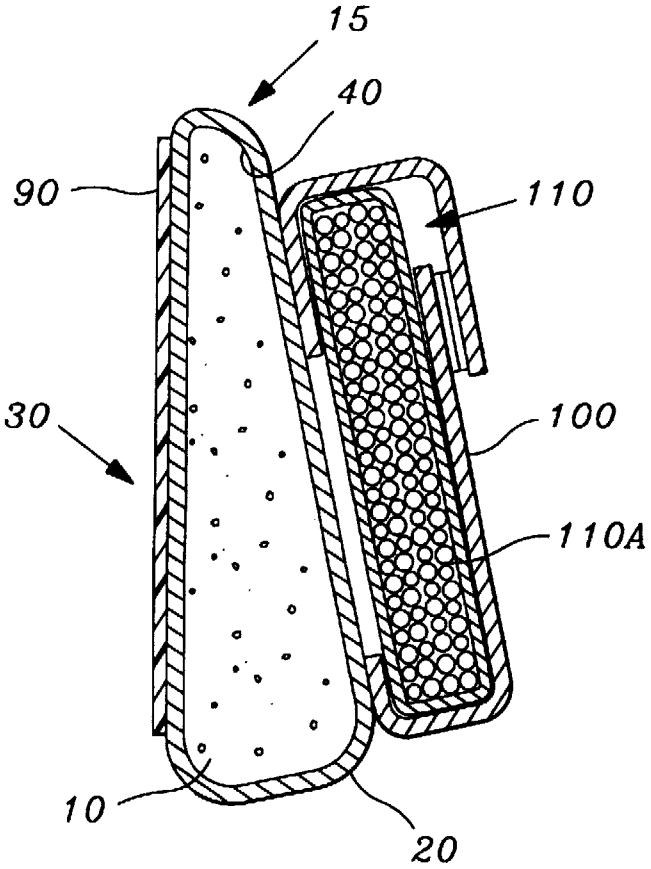
FIG. 2 is a section view taken along line 2—2 in FIG. 1 and particularly shows the interior construction of the invention in a first embodiment.

The invention is a jogging belt 5 device to be worn around a jogging person's waist as best seen in FIG. 1. The belt device includes an elongate strip 15 including a resilient material 10 such as foam rubber, of a length for encircling a major portion of the person's waist. As seen in FIG. 1, the front of the torso is preferably not necessarily encircled by the elongate strip 10. As best seen in FIGS. 2 and 3, the strip 15 is preferably enclosed within a covering of flexible fabric 20. The strip 15 with its fabric covering 20, provides an in-facing surface 30 which is in contact with the person's waist, an outfacing mounting surface 40 and a pair of opposing free ends 50 and 60. An adjustable attachment means 70 joins the free ends 50, 60 of the strip 15 for enclosing the strip 15 about the person's waist and for tightening the belt 5. Such an attachment means 70 may be a strap or a pair of straps of hook and loop type fastener material, or any of the well known belt fastener devices used for such duty. FIG. 1 shows a clip fastener 80 means as is known in the art. The belt 5 further preferably includes a high friction layer 90 engaged with the in-facing surface 30 of the strip 15 for retarding slipping of the device 5 when it is tightened about the person's waist.

At least one, but preferably, a plurality of pouches 100 are fixed to the mounting surface 40 of the strip 15 in positions arranged in side-by-side adjacency around the elongate strip as shown in FIG. 1. Each of the pouches 100 provides a weight means 110 preferably enclosed within each of the pouches 100. The weight means 110, in one embodiment, is a plurality of small weight elements 110A such as metal shot, buck-shot, ball-bearings, or any form of particle or powdered heavy material. In this form, the weight 110 has the advantage of conforming to the curvature of the strap 15 so as to be more comfortable, i.e., bending to conform to the waist.

In an alternate embodiment, the weight means 110 is a single rigid block 110B of a material of high weight density such as steel, iron or lead. This block 110B is supported by a spring means 120 such as one or more coil springs as shown in FIG. 3. Preferably, the invention includes a means for adjusting 130 the spring constant of the spring means such as the screws shown in FIG. 3, wherein the depth of penetration of the screws into the coil springs determines the spring constant of the springs. In this case, the inner diameter of the springs 120 is such as to accept the screws 130 in self threading relationship, so that the screws attach the weight 110B at the ends of the springs. The springs 120 act together with the foam rubber strip 15 to provide the necessary time delay so that, while jogging, the maximum downward force of the weight 110B is retarded with respect to that of the persons body weight in general, during each stride.

The resilient strip is preferably of a shape for supporting the pouches at an angle inclined to the person's waist such that a component of the downward force of each of the weights is directed toward compressing the resilient strip. The strip, because of its resiliency, provides a strip spring constant which also causes the peak of the downward force of each of the weights to be delayed with respect to the peak of the downward force of the person's body weight during the jogging exercise.

During jogging exercise, the weight of the jogger is applied to his knee and foot joints in a cyclic manner. The jogger's body weight produces a maximum downward force on each leg alternately as each leg supports the body during each upward thrust of the respective leg. It is well known in sports medicine that forces on each leg reach a maximum during the time when the body is caused to change its vertical direction from downward to upward. During this time, the direction of movement of weight 110A or 110B is also changed. However, due to the resilience of the strip 15 and the spring means 120, the maximum downward force due to the invention is delayed by up to one-half of a second. The result of this delay is to extend the time duration during which forces are applied to the leg joints so that the magnitude of these forces, at any one instant, does not reach a level where damage might occur to the joints.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A jogging belt device to be worn around a jogging person's waist, the device comprising:

an elongate strip of resilient material of a length for encircling a portion of the person's waist, the strip providing an in-facing surface in contact with the person's waist, an outfacing mounting surface and a pair of opposing free ends;

an adjustable attachment means joining the free ends of the strip for enclosing the strip about the person's waist and for tightening the belt around the person's waist;

a plurality of pouches fixed to the mounting surface of the strip in positions arranged in side-by-side adjacency around the elongate strip;

each of the pouches providing a weight means;

the resilient strip having a triangular cross-sectional shape for supporting the pouches at an upwardly directed angle inclined to the person's waist such that a component of the downward force of each said weight is directed to compressing the resilient strip, the strip being of such resilience as to cause the peak of the downward force of each said weight to be delayed with respect to the peak of the downward force of the person's body weight.

2. The device of claim 1 wherein the weight means is a single rigid block of high weight density material supported by a spring means.

3. The device of claim 2 further including a means for adjusting the spring constant of the spring means.

* * * * *